US005887741A

United States Patent [19]

Chiang

[11] Patent Number: 5,887,741

[45] Date of Patent: Mar. 30, 1999

[54] DETACHABLE FOOD CONTAINER

[76] Inventor: Yi-Cherng Chiang, 8F-5, No 155, Wen-Tian Rd, Kaohsiung, Taiwan

[21] Appl. No.: 932,153

[22] Filed: Sep. 17, 1997

[51] Int. Cl.[6] ..... B65D 6/24; B65D 6/26

[52] U.S. Cl. ..... 220/4.31; 220/4.28; 220/666; 220/682; 206/577

[58] Field of Search ..... 220/4.28, 4.31, 220/666, 529, 915.1, 680, 682, 690; 206/577; 229/117.02

[56] References Cited

U.S. PATENT DOCUMENTS

| | | | |
|---|---|---|---|
| 883,002 | 3/1908 | Davis | 220/4.31 |
| 2,026,311 | 12/1935 | Harris | 220/682 |
| 2,091,140 | 8/1937 | Davis | 220/682 |
| 2,119,799 | 6/1938 | Sivey | 220/4.28 |
| 2,611,460 | 9/1952 | Nash | 220/4.31 |
| 4,085,847 | 4/1978 | Jacalone | 229/117.02 |
| 4,454,946 | 6/1984 | Yokowo | 229/117.02 |
| 4,828,132 | 5/1989 | Francis, Jr. et al. | 220/4.31 |
| 5,704,508 | 1/1998 | Keip et al. | 220/4.31 |

FOREIGN PATENT DOCUMENTS

| | | | |
|---|---|---|---|
| 378362 | 4/1973 | U.S.S.R. | 220/680 |

*Primary Examiner*—Stephen Castellano

*Attorney, Agent, or Firm*—David and Raymond; Raymond Y. Chan

[57] ABSTRACT

A detachable food container includes a base plate having a periphery base rim integrally and perpendicularly extended from a periphery side of the base plate; two fold plates which has an end piece perpendicularly and integrally bent on each end thereof; two side plates which both ends each provides a V-shape fork means to engage with the respective end piece of the corresponding fold plate in order to form a hollow quadrilateral frame body which is placed on top of the base plate and bounded by the base rim thereof; and a top lid cover having a periphery cover rim integrally and perpendicularly extended from a periphery side of the top lid cover for covering on top of the hollow quadrilateral frame body to form the detachable food container. When the detachable food container is not used or no food is carried therein, the two fold plates and the two side plates can be detached apart and arranged on top the top place, and that the top lid cover is able to cover on top of the base plate to form a collapse structure having a minimum size and form to reduce the carrying room and storing space.

10 Claims, 8 Drawing Sheets

DETACHABLE FOOD CONTAINER

FIELD OF THE PRESENT INVENTION

The present invention relates to a container for carrying food, and more particularly to a detachable food container comprising different components detachably assembled into a square or a circular food container for people to carry their lunch to work or to carry food during outdoor activity. When people finish their food in the detachable food container, the user can detach the food container and assemble to form a small size box for reducing carrying room and storing space.

BACKGROUND OF THE PRESENT INVENTION

In today's competitive society, people spend all their time try to move up in the society. People who can well manage their time are usually at the top of class, those who don't treasure their time, are unable to keep up. This kind of competitive environment starts as early as school years, and gets more competitive in the working environment. But still, people need to eat to restore the necessary energy to go further, therefore the most effective and convenient way to have lunch without wasting time is to bring your own lunch. It can eliminate the traveling time between the work place to the restaurant, and the waiting time at the restaurant. That is just exactly what a lot of business people are doing now, having a simple fast lunch, then a decent and relax dinner with the family.

Normally, the conventional food container that the people use to carry their food has a container body and a lid to cover the container body. The container body is usually integrally formed, that is unable to detach and takes large space to store. Therefore, it may not be able to store in the brief case of the businessman or businesswoman. People often need to bring a separate bag especially just to carry the food container that creates great inconvenience.

There are other types of the food container which are made of the paper board or polylone. When these products are first in use, we believe that these types of the food container are very convenience because the paper board or the polylone made food container can just be throw away after used. But now that we are more environmental conscious, we know that if we don't recycle what we used, our forests would be gone, and there would be land filled everywhere. The polylone also has further hazard of emitting poison substance that can be harmful to human health when it is in contact with hot food.

The above described paper board or polylone food container further has the following shortcoming:

Because the disposable food container is conventionally made of the paper board, polylone or thin wood piece, it can not withstand high pressure. When the food container is accidentally pressed or encountered pressure, the food that is stored within the food container might leak out and pollute the carrying bag or, in the worst case, all the documents in the brief case if the food container was originally carrying in the brief case. When the above described incident happens, not only the food is wasted, but also the user needs to find a good explanation on why all his or her works are filled with grease.

As mentioned above, the conventional disposable food container are made of the paper board or thin wood plate. This type of the food container is very convenience because the users do not need to clean the container after used, but instead just throw away the waste. However, we know that the paper board and wood are all come from our natural forest, if people stop using these types of material, then our forest can be saved to last longer for our future generation. Also, if we can re-use our food container, then the trash we generate each day can be greatly reduced, awarding less the burden on our environment.

SUMMARY OF THE PRESENT INVENTION

The main objective of the present invention is to provide a detachable food container which is economical, convenience and safe to use.

Another objective of the present invention is to provide a detachable food container which comprises a base plate, two fold plates, two side plates, and a top lid. By assembling the above mentioned components can easily and quickly construct the detachable food container of the present invention. After the user finishes the food stored within the container, the user can easily and quickly detach the container and reassemble into a smaller size and form of container with less total volume for easier carry and storage. The detachable food container of the present invention can be re-used over and over again and thus eliminate garbage disposal problem to benefit the environment.

Accordingly, a detachable food container comprises a base plate which is a quadrilateral plate having a first and a second pair of parallel upper straight base rims integrally and perpendicularly extended from four sides of the base plate;

two fold plates which are quadrilateral plates each having a length equal to or slightly shorter than an inner length of the first pair of base rims and a width equal to or slightly less than a half width of the base plate, wherein each fold plate further has two end pieces integrally and perpendicularly extended from two end sides of the fold plate respectively, so that when the fold plates are perpendicularly positioned on the base plate, two outer surfaces of two bottom portions of the two fold plates are abutting against two inner surfaces of the first pair of base rims of the base plate respectively, and that a height of each end piece of each fold plate is equal to or less than a height of each base rim of the base plate;

two side plates which are also quadrilateral plates each having a length equal to or shorter than an inner length of the second pair of base rims of the base plate and a width equal to a width of each fold plate, both ends of each side plate each having a V-shape fork means for engaging with the respective end piece of the corresponding fold plate perpendicularly, so that the two fold plates and the two side plates are assembled side to side to form a hollow quadrilateral frame body vertically and upwardly extended from the base plate; and a top lid cover which is a quadrilateral plate having two pairs of lower straight cover rims integrally and perpendicularly extended from four sides of the top lid cover, in which a size of the top lid cover is equal to or slightly larger than the base plate, so that when the top lid cover is positioned on top of the hollow quadrilateral frame body, four inner surfaces of the four lower straight cover rims of the top lid cover are abutting against the outer surfaces of the upper portion of the two fold plates and the two side plate respectively for covering the interior of the hollow quadrilateral frame body.

To detach the detachable food container of the present invention is easy and convenience. First, disengage the two fold plates from the two side plates. Second, arrange the two fold plates and the two side plates on the base plate, in which the two fold plates are placed on the base plate longitudinally side by side, and the two side plates are transversally placed on top of the two fold plates side by side, so that the two fold plates and the two side plates are able to be received within a cavity bounded by the four base rims of the base plate. Third, the top lid cover is covered on top of the base plate so as to reassemble the detachable food container of the present invention to a collapse structure having minimum size and form when it is not used or has no food carried therein.

DETAILED DESCRIPTION OF THE PREFERRED EMBODIMENTS

Figure 1:
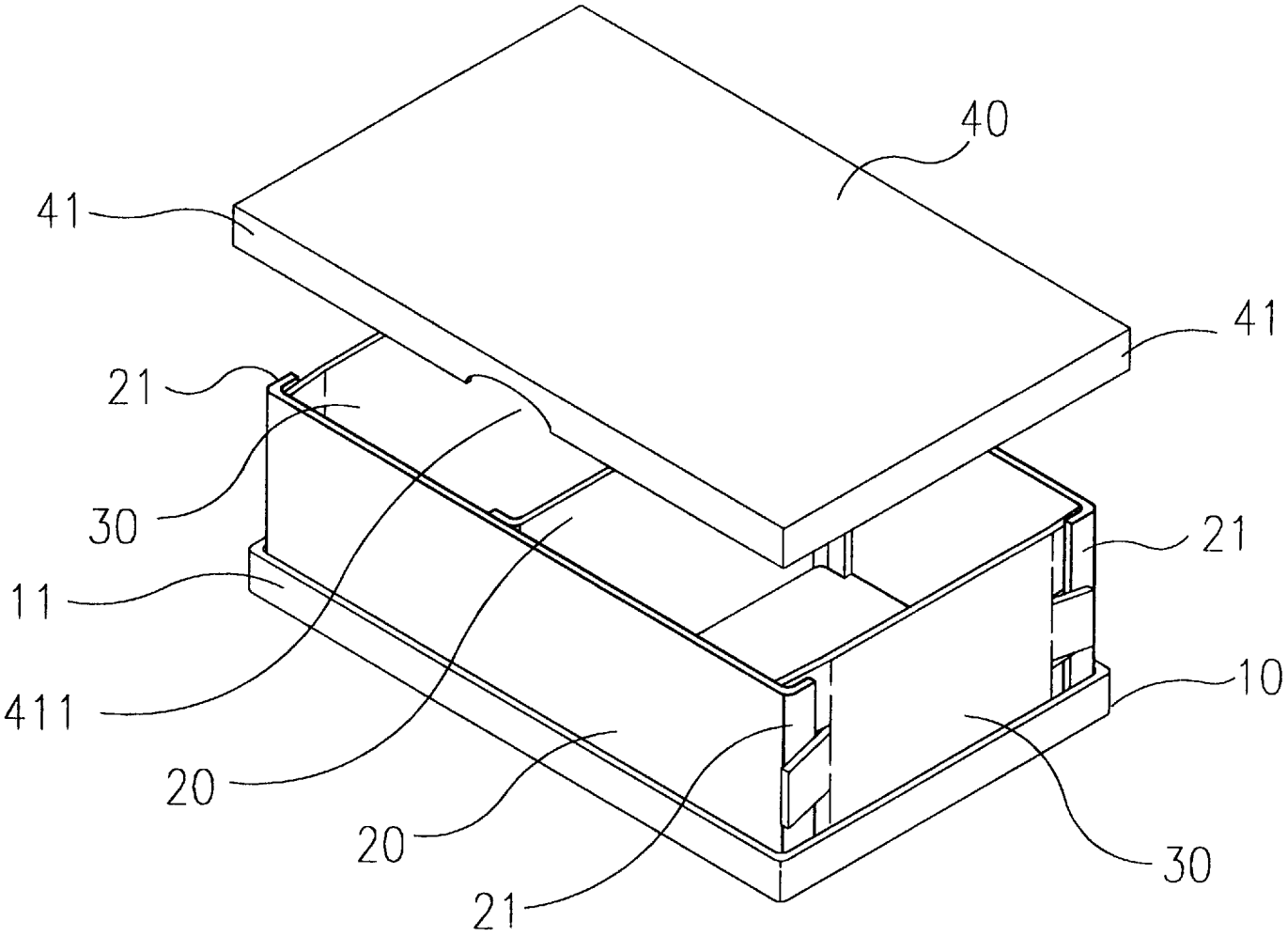
FIG. 1 is a perspective view of a detachable food container according to a first preferred embodiment of the present invention.

Referring to FIG. 1 to FIG. 6 of the drawings, a detachable food container according to a first preferred embodiment of the present invention is illustrated. The detachable food container comprises a base plate 10, two fold plates 20, two side plates 30, and a top lid cover 40.

The base plate 10 is a quadrilateral plate having a first and a second pair of parallel upper straight base rims 11 integrally and perpendicularly extended from four sides of the base plate 10.

The two fold plates 20 are two identical quadrilateral plates each having a length equal to or slightly shorter than an inner length of the first pair of base rims 11 and a width equal to or slightly shorter than a half width of the base plate 10. Each fold plate 20 further has two end pieces 21 integrally and perpendicularly extended from two end sides of the fold plate 20 respectively, so that when the fold plates 20 are perpendicularly positioned on the base plate 10, two outer surfaces of two bottom portions of the two fold plates are abutting against two inner surfaces of the first pair of base rims 11 respectively. A height of each end piece 21 of each fold plate 20 is equal to or less than a height of each base rim 11 of the base plate 10.

The two side plates 30 are also two identical quadrilateral plates having a length equal to or shorter than an inner length of the second pair of base rims 11 of the base plate 10 and a width equal to a width of each fold plate 20. Both ends of each side plates 30 each has a V-shape fork means engaging with the respective end piece 21 of the corresponding fold plate 20 perpendicularly, so that the two fold plates 20 and the two side plates 30 are assembled side to side to form a hollow quadrilateral frame body vertically and upwardly extended from the base plate 10.

The top lid cover 40 which is a quadrilateral plate having two pairs of lower straight cover rims 41 integrally and perpendicularly extended from four sides of the top lid cover 40, in which a size of the top lid cover 40 is equal to or slightly larger than the base plate 10, so that when the top lid cover 40 is positioned on top of the hollow quadrilateral frame body, four inner surfaces of the four lower straight cover rims 41 of the top lid cover 40 are abutting against the outer surfaces of the upper portion of the two fold plates 20 and the two side plates 30 respectively for covering the interior of the hollow quadrilateral frame body.

Figure 2:
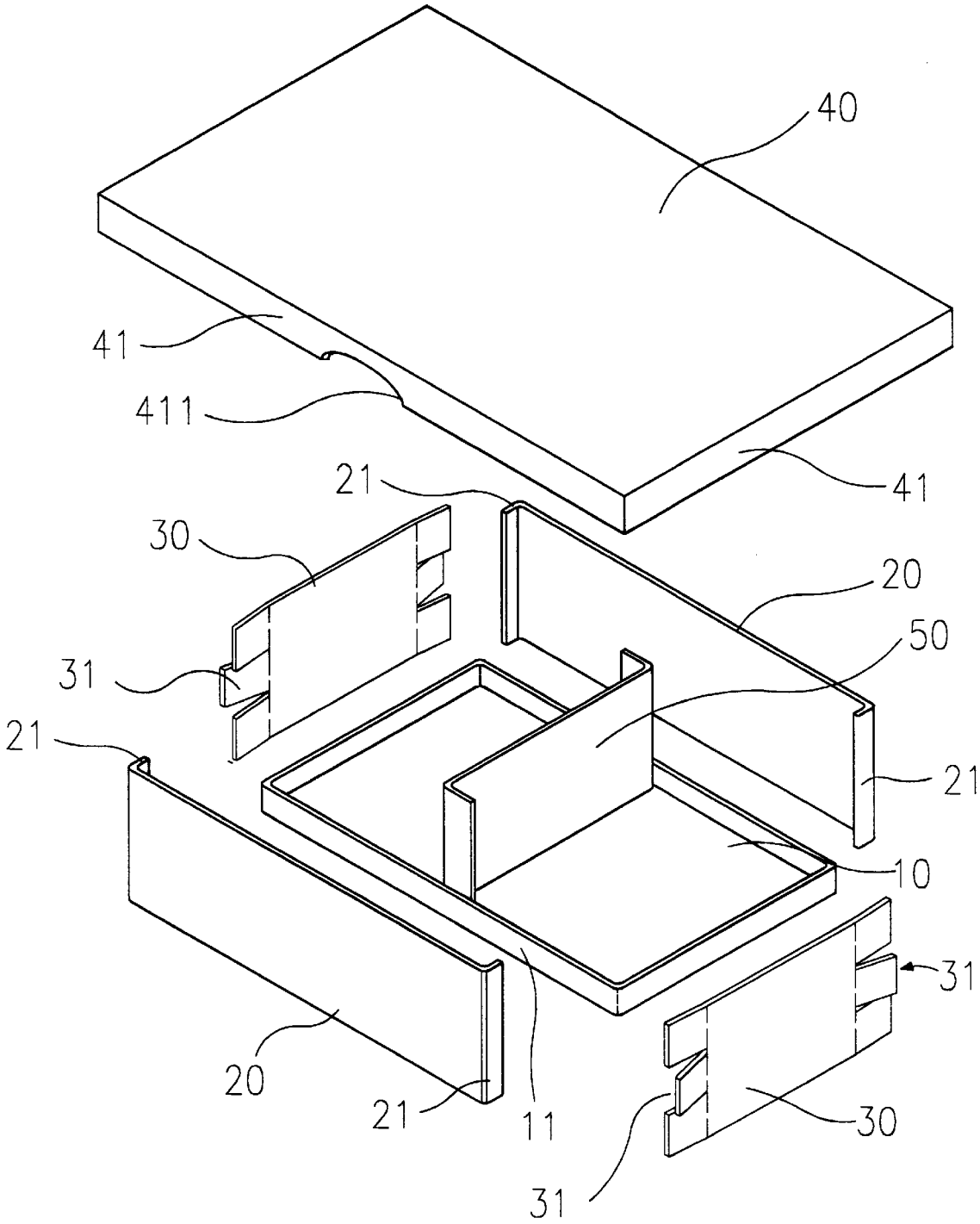
FIG. 2 is an exploded perspective view of the detachable food container according to the above first preferred embodiment of the present invention.
Figure 3:
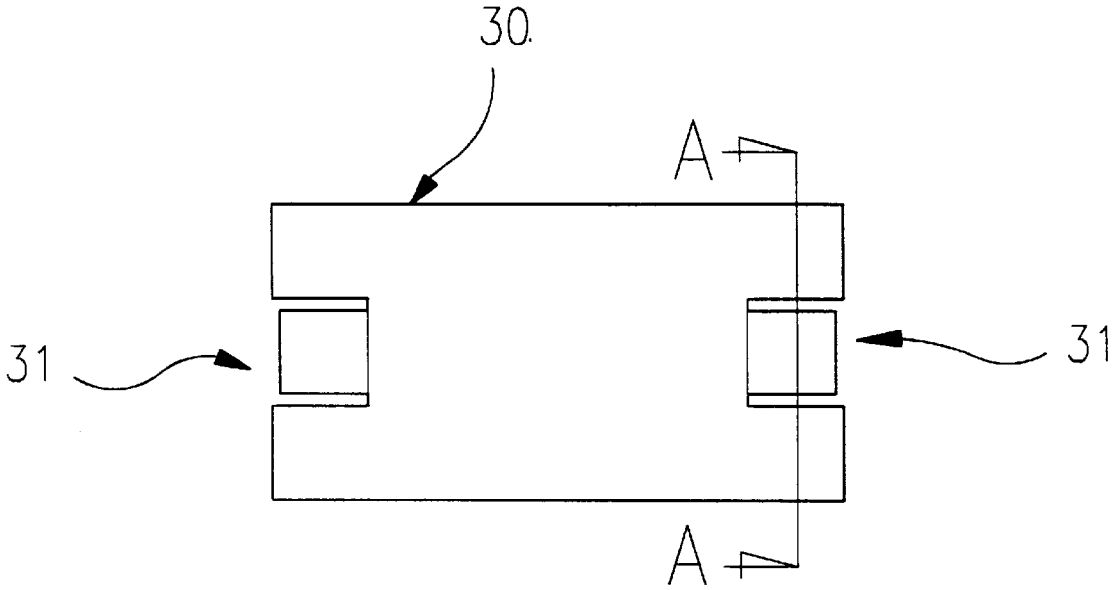
FIG. 3 is a front view of the side plate of the detachable food container according to the above first preferred embodiment of the present invention.
Figure 4:
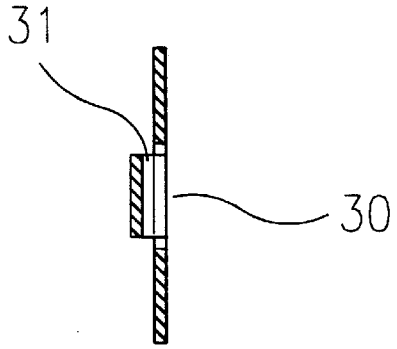
FIG. 4 is a sectional end view of the side plate, viewed at section line A—A of FIG. 3, according to the above first preferred embodiment of the present invention.
Figure 5:
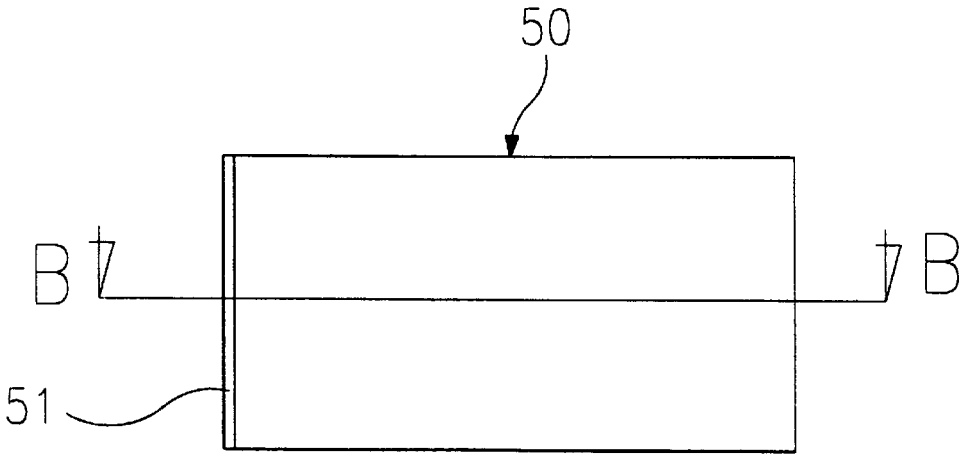
FIG. 5 is a front view of the divide plate of the detachable food container according to the above first preferred embodiment of the present invention.
Figure 6:
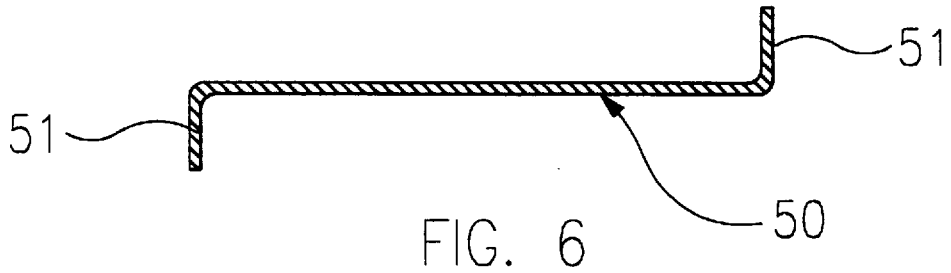
FIG. 6 is a sectional end view the divide plate, viewed at section line B—B of FIG. 5, according to the above first preferred embodiment of the present invention.

As shown in FIGS. 2, 3 and 4, the V-shape fork means provided at each end portion of each side plate 30 is constructed by equally and spacedly cutting out the end portion of the side plate 30 to form a top portion, a bottom portion and a middle portion between the top and bottom portions, wherein the top portion and the bottom portion are inwardly bent and the middle portion is bent outwardly to form a receiving clip 31 therebetween.

As shown in FIGS. 1 and 2, to assemble the detachable food container of the present invention, no connection elements such as screws or rivets are required. The user may simply insert the four end pieces 21 of the two fold plates 20 into the four receiving clips 31 of the two side plates 30 respectively, so as to firmly engaged the two fold plates 20 and the two side plates 30 together to form the rigid quadrilateral frame body, as shown in FIG. 1, which is then positioned on top of the base plate 10. The two pairs of the base rims 11 thus form a boundary to fittedly hold the two fold plates 20 and the two side plates 30 in position to prevent the quadrilateral frame body from collapse. Finally, the top lid cover 40 is placed on top of the quadrilateral frame body, wherein the two pairs of the cover rims 41 will further fittedly bound the two fold plates 20 and the two side plates 30 in position and cover the interior of the quadrilateral frame body to form the detachable food container.

In accordance with the first preferred embodiment of the present invention, the detachable food container can further comprises a dividing plate 50 for separating the detachable food container into two area for different kinds of food. As shown in FIGS. 1, 2, 5, and 6, the dividing plate 50 has a length shorter than the length of the side plates 30 and a width less than or equal to the width of the fold plates 20. The dividing plate 50 further provides two bending portions 51 respectively and perpendicularly extended from two ends of the dividing plate 50 in opposite direction. As shown in FIG. 1, the divide plate 50 is positioned between the two fold plates 20 of the quadrilateral frame body by tightly propping two outer surfaces of the two bending portions 51 respectively against the two inner surfaces of the two fold plates 20 of the quadrilateral frame body of the detachable food container.

Moreover, as shown in FIGS. 1 and 2, on a predetermined position on each of the first pair of lower straight cover rims 41, an indention 411 is provided thereon for providing an easier way to take the top lid cover 40 off the detachable food container.

Figure 7:
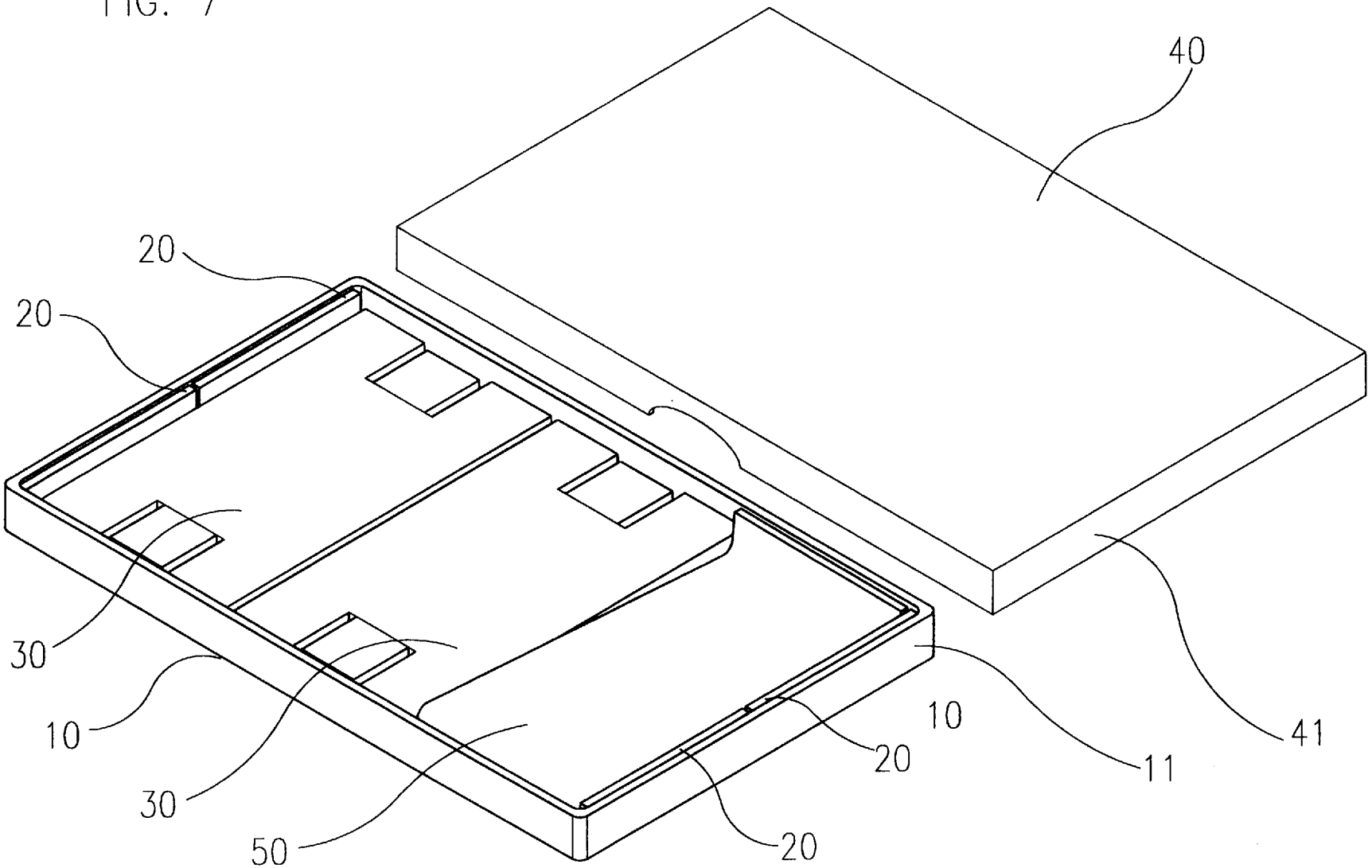
FIG. 7 is a perspective view of the detachable food container according to the above first preferred embodiment of the present invention, in which all the fold plates and side plates are detached and overlapped on the base plate to reassemble to a minimum size and form.
Figure 8:
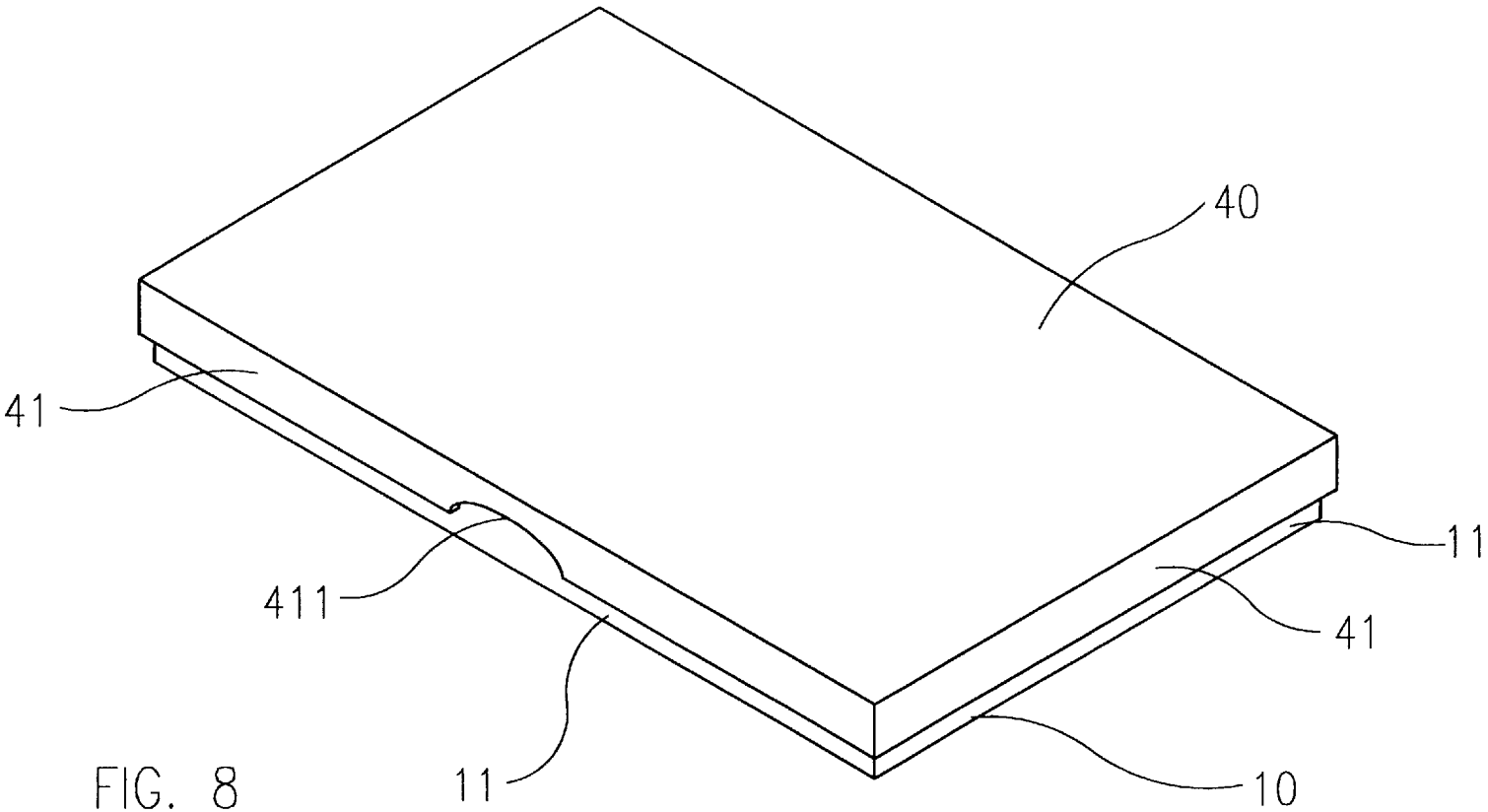
FIG. 8 is a perspective view of the collapse structure of the detachable food container according to the above first preferred embodiment of the present invention.

Referring to FIGS. 7 and 8, to detach the detachable food container of the present invention is easy and convenience. First, remove the frame body of the two fold plates 20 and the two side plates 30 from the base plate 10 and disengage the two fold plates 20 from the two side plates 30 by pulling four end pieces 21 of the two fold plates 20 form the corresponding four receiving clips 31 of the four V-shape fork means of the two side plates 30. Second, arrange the two fold plates 20, the two side plates 30 and the divide plate 50 on the base plate 10, in which the two fold plates 20 are placed on the base plate 10 longitudinally side by side, and the two side plates 30 and the divide plate 50 are transversally placed on top of the two fold plates 20 side by side, as shown in FIG. 7, so that the two fold plates 20, the two side plates 30 and the divide plate 50 are able to be received within a cavity bounded by the four base rims 11 of the base plate 10. Third, the top lid cover 40 is covered on top of the base plate 10, as shown in FIG. 8, so as to reassemble the detachable food container of the present invention to a collapse structure having minimum size and form when it is not used or has no food carried therein. Accordingly, the detachable food container is constructed into the minimum size and form which reduces the carrying room and storing space thereof.

Figure 9:
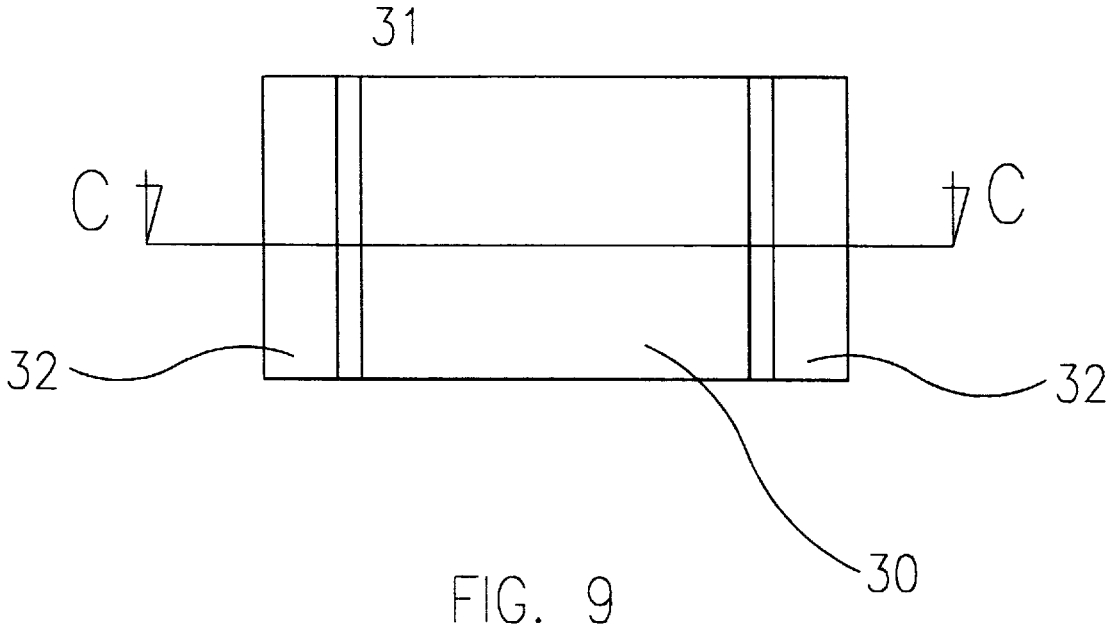
FIG. 9 is a front view of an alternative mode of the side plate of the detachable food container according to the above first preferred embodiment of the present invention.
Figure 10:
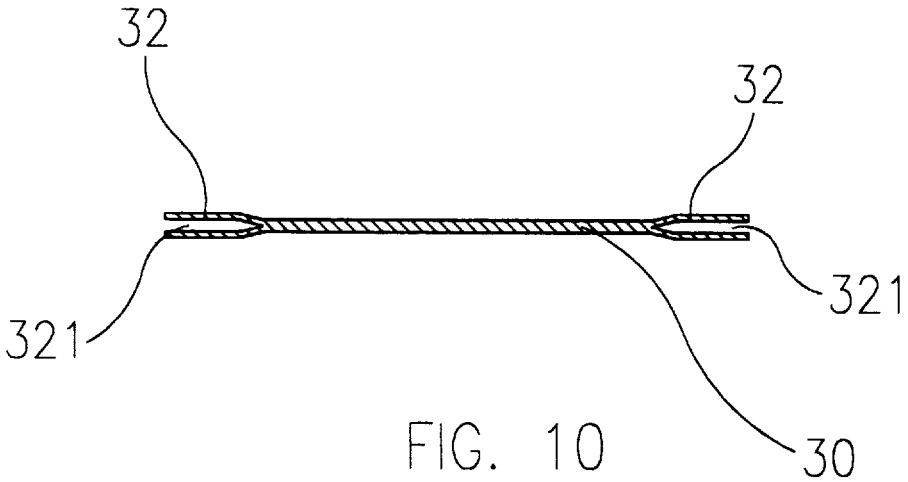
FIG. 10 is a sectional end view of the alternative side plate, viewed at section line C—C of FIG. 9, according to the above first preferred embodiment of the present invention.

As shown in FIG. 9 and FIG. 10, an alternative mode of the side plates 30 of the present invention is illustrated, in which the two ends of the side plates 30 is alternatively constructed to each provide a Y-shape holder 32 which has a receiving groove 321 for the insertion of the respective end piece 21 of the fold plates 20.

Referring to FIG. 11 to FIG. 15, a second preferred embodiment of the detachable food container of the present invention is illustrated. The detachable food container comprises a circular base plate 10', a plurality of flexible rectangular side plates 30', and a circular top lid cover 40'.

Figure 12:
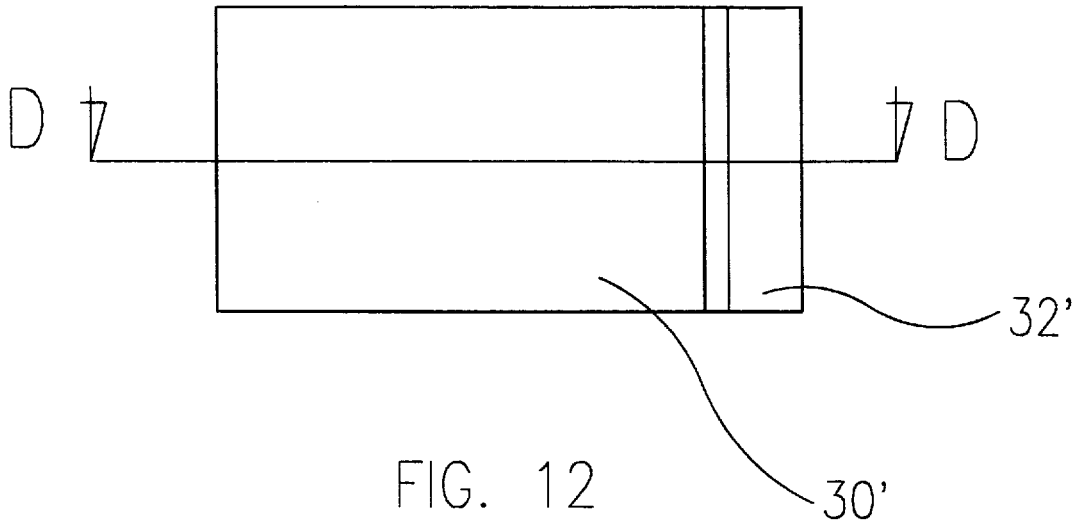
FIG. 12 is a front view of the side plate of the detachable food container according to the above second preferred embodiment of the present invention.
Figure 13:
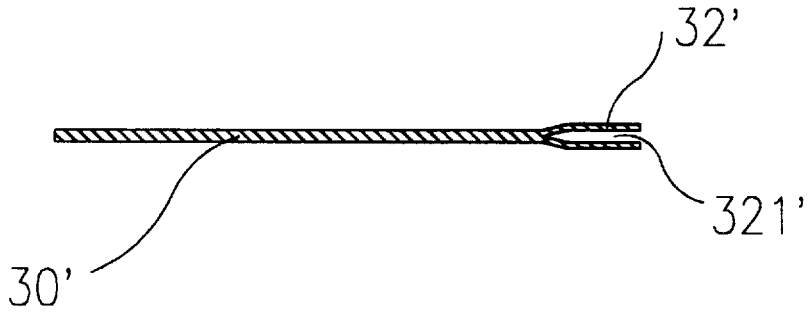
FIG. 13 is a sectional end view of the side plate, viewed at section line D—D of FIG. 12, according to the above second preferred embodiment of the present invention.

The circular base plate 10' is a circular plate having a circular base rim 11' integrally and upwardly extended from a periphery side of the circular base plate 10'. As shown in FIGS. 12 and 13, each of the flexible rectangular side plates 30' comprises a flat end 31' and a Y-shape holding end 32' which has a receiving groove 321' for engaging with the flat end 31' of another side plate 30'. The flexible rectangular side plates 30' are positioned one after another in a manner that the flat end 31' the first flexible rectangular side plates 30' is inserted into the receiving groove 321' of the Y-shape holding end 32' of the second flexible rectangular side plates 30' and so on, and the flat end 31' of the last flexible rectangular side plates 30' is looped around to be engaged within the Y-shape holding end 32' of the first flexible rectangular side plates 30'. These plurality of the flexible rectangular side plates 30' are thus formed a tubular frame body of the detachable food container.

The tubular frame body of the side plates 30' is fittedly positioned on top of the base plate 10', wherein the frame body of the side plates 30' is firmly bounded by the circular base rims 11' of the base plate 10' to form a circular box body to store food therein.

Figure 11:
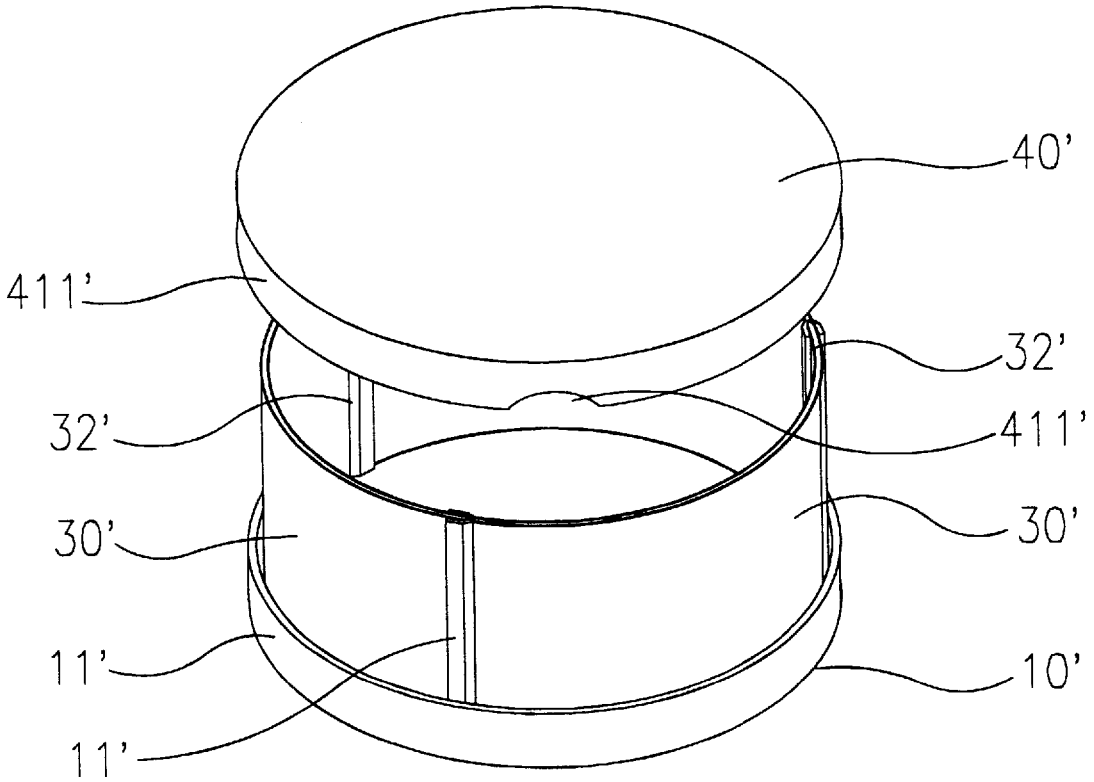
FIG. 11 is a perspective view of an alternative mode of the detachable food container according to a second preferred embodiment of the present invention.

The top lid cover 40' is also a circular plate having a circular cover rims 41' integrally and downwardly extended from a periphery side of the circular plate. The top lid cover 40' has a size slightly larger than the circular base plate 10', wherein the top lid cover 40' is used to cover on top of the circular box body to close the interior thereof in order to constructed a complete circular detachable food container of the second preferred embodiment of the present invention, as shown in FIG. 11.

Figure 15:
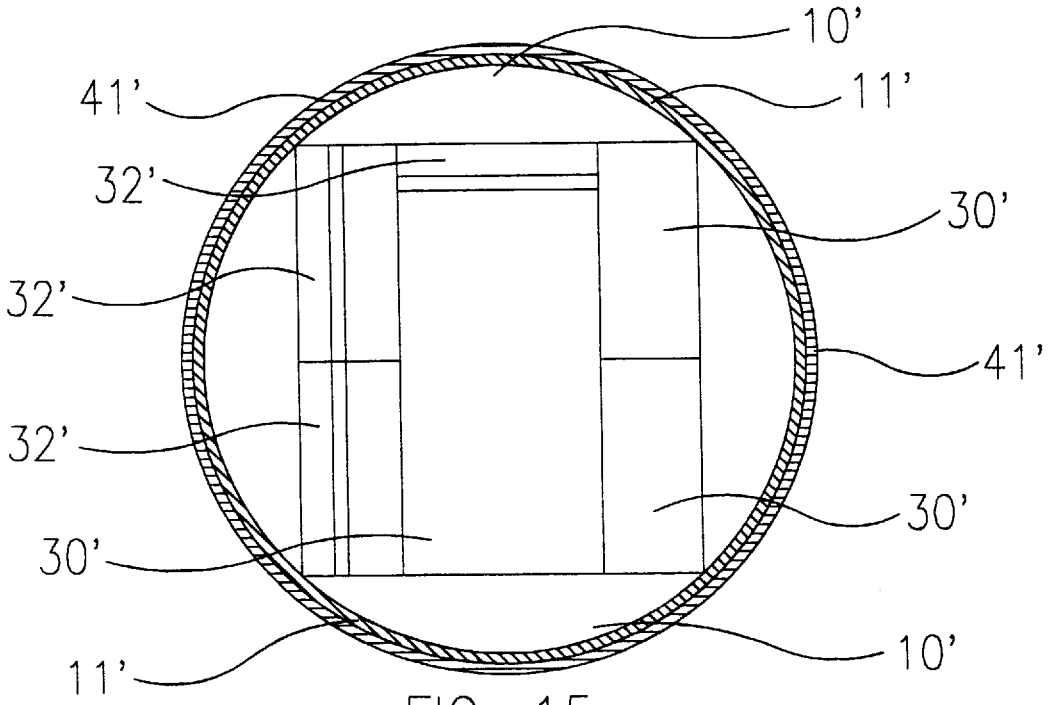
FIG. 15 is a sectional top view of the collapsed detachable food container, viewed at section line E—E of FIG. 14, according to the above second preferred embodiment of the present invention.
Figure 14:
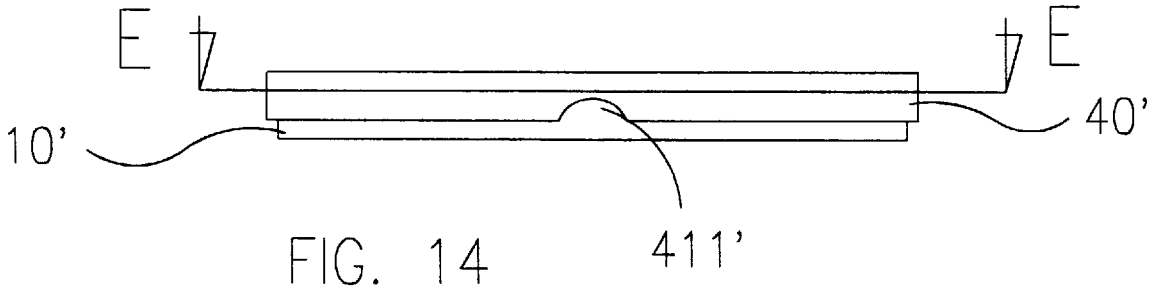
FIG. 14 is a front view of a collapse structure of the detachable food container according to the above second preferred embodiment of the present invention.

When the circular detachable food container of the present invention is not in use to store food, the user may simply and easily detach the components to form a collapse structure as shown in FIGS. 14 and 15. The side plates 30' are detached from each other and arranged on top of the base plate 10' respectively, as shown in FIG. 15. The top lid cover 40' can be further covered on the base plate 10' to form the collapse structure having a minimum size and form for easy carrying and storage. Furthermore, as shown in FIGS. 11 and 14, on a predetermined position on the cover rims 41' has at least an indention 411' for providing an easier opening to take the circular top lid cover 40' off the detachable food container.

Accordingly, the present invention provides at least the following benefits:

First, to those who need to bring lunch to work, they can bring the lunch in the detachable food container. When lunch is over, the detachable food container is washed and can be detached to its minimum collapse structure and be carried home by the brief case, providing great convenience.

Second, the user can use the detachable food container of the present invention to carried food purchased in the fast food restaurant or self served restaurant, so that the food is guarantee to be placed in the clean container, resulting in a health and clean food.

Third, the detachable food container of the present invention can be easily washed after each used and ready to be used again, therefore, the present invention can be reused over and over again. This would help our environmental by reduced trash production and destruction of the forest.

What is claimed is:

1. A detachable food container, comprising a base plate which is a quadrilateral plate having a first and a second pair of parallel base rims integrally and perpendicularly extended from four sides of said base plate;

two fold plates which are two identical quadrilateral plates each having a length equal to an inner length of said first pair of base rims and a width equal to a half width of said base plate, each of said fold plates further having two end pieces integrally and perpendicularly extended from two end sides of said fold plate respectively, so that when said fold plates are perpendicularly positioned on said base plate, two outer surfaces of two bottom portions of said two fold plates are abutting against two inner surfaces of said first pair of base rims respectively, and that a height of each of said end pieces of each of said fold plates is equal to a height of each of said base rims of said base plate;

two side plates which are also two identical quadrilateral plates having a length equal to an inner length of said second pair of base rims of said base plate and a width equal to a width of each of said fold plates, both ends of each of said side plates each having a V-shape fork means engaging with said respective end piece of said corresponding fold plate perpendicularly, so that said two fold plates and said two side plates are assembled side to side to form a hollow quadrilateral frame body vertically and upwardly extended from said base plate, and a top lid cover which is a quadrilateral plate having two pairs of cover rims integrally and perpendicularly extended from four sides of said top lid cover, in which a size of said top lid cover is slightly larger than said base plate, so that when said top lid cover is positioned on top of said hollow quadrilateral frame body, four inner surfaces of said four cover rims of said top lid cover are abutting against four outer surfaces of four upper portions of said two fold plates and said two side plates respectively for covering an interior of said hollow quadrilateral frame body to form said detachable food container;

whereby, by removing said quadrilateral frame body of said two fold plates and said two side plates from said base plate and disengaging said two fold plates from said two side plates by pulling said four end pieces of said two fold plates form said corresponding four fork means of said two side plates, and then arranging said two fold plates and said two side plates on said base plate, in which said two fold plates are placed on said base plate longitudinally side by side, and said two side plates are transversally placed on top of said two fold plates side by side, so that said two fold plates and said two side plates are able to be received within a cavity bounded by said four base rims of said base plate, and finally by covering said top lid cover on top of said base plate, said detachable food container is reassembled to a collapse structure having a minimum size and form.

2. A detachable food container, as recited in claim 1, wherein said V-shape fork means provided at each of said end portions of each of said side plate is constructed by equally and spacedly cutting out said end portion of said side plate to form a top portion, a bottom portion, and a middle portion between said top and bottom portions, wherein said top portion and said bottom portion are inwardly bent and said middle portion is bent outwardly to form a receiving clip therebetween, so that said four end pieces of said two fold plates are simply inserted into said four receiving clips of said two side plates respectively, so as to firmly engaged said two fold plates and said two side plates together to form said rigid frame body which is then positioned on top of said base plate, therefore said two pairs of said base rims form a boundary to fittedly hold said two fold plates and said two side plates in position to prevent said frame body from collapse.

3. A detachable food container, as recited in claim 1, further comprising a dividing plate for separating said detachable food container into two area, wherein said dividing plate has a length shorter than said length of said side plates and a width equal to said width of said fold plates, said dividing plate further providing two bending portions which are respectively and perpendicularly extended from two ends of said dividing plate in opposite direction, said divide plate being positioned between said two fold plates of said frame body by tightly propping two outer surfaces of said two bending portions respectively against two inner surfaces of said two fold plates of said frame body of said detachable food container.

4. A detachable food container, as recited in claim 2, further comprising a dividing plate for separating said detachable food container into two area, wherein said dividing plate has a length shorter than said length of said side plates and a width equal to said width of said fold plates, said dividing plate further providing two bending portions which are respectively and perpendicularly extended from two ends of said dividing plate in opposite direction, said divide plate being positioned between said two fold plates of said frame body by tightly propping two outer surfaces of said two bending portions respectively against two inner surfaces of said two fold plates of said frame body of said detachable food container.

5. A detachable food container, as recited in claim 1, wherein on a predetermined position on each of said first pair of cover rims, an indention is provided thereon for providing an easier way to take said top lid cover off said detachable food container.

6. A detachable food container, as recited in claim 2, wherein on a predetermined position on each of said first pair of cover rims, an indention is provided thereon for providing an easier way to take said top lid cover off said detachable food container.

7. A detachable food container, as recited in claim 4, wherein on a predetermined position on each of said first pair of cover rims, an indention is provided thereon for providing an easier way to take said top lid cover off said detachable food container.

8. A detachable food container, as recited in claim 1, wherein said V-shape fork means provided at said two ends of said side plates is constructed to each provide a Y-shape holder which has a receiving groove for said insertion of said respective end piece of said corresponding fold plates.

9. A detachable food container, as recited in claim 8, further comprising a dividing plate for separating said detachable food container into two area, wherein said dividing plate has a length shorter than said length of said side plates and a width equal to said width of said fold plates, said dividing plate further providing two bending portions which are respectively and perpendicularly extended from two ends of said dividing plate in opposite direction, said divide plate being positioned between said two fold plates of said frame body by tightly propping two outer surfaces of said two bending portions respectively against two inner surfaces of said two fold plates of said frame body of said detachable food container.

10. A detachable food container, as recited in claim 9, wherein on a predetermined position on each of said first pair of cover rims, an indention is provided thereon for providing an easier way to take said top lid cover off said detachable food container.

* * * * *